US006581811B1

(12) United States Patent
Schillaci

(10) Patent No.: US 6,581,811 B1
(45) Date of Patent: Jun. 24, 2003

(54) WEARABLE CONTAINER

(76) Inventor: Simon Schillaci, 117 Evergreen Place SW., Calgary, Alberta (CA), T2Y 3K7

( * ) Notice: Subject to any disclaimer, the term of this patent is extended or adjusted under 35 U.S.C. 154(b) by 0 days.

(21) Appl. No.: 09/787,935

(22) PCT Filed: Sep. 21, 1999

(86) PCT No.: PCT/CA99/00857

§ 371 (c)(1),
(2), (4) Date: Mar. 21, 2001

(87) PCT Pub. No.: WO00/16657

PCT Pub. Date: Mar. 30, 2000

(30) Foreign Application Priority Data

Sep. 22, 1998 (CA) ..... 2248297

(51) Int. Cl.[7] ..... A45F 5/00

(52) U.S. Cl. ..... 224/148.2; 224/148.6; 222/175; 220/666

(58) Field of Search ..... 220/666; 224/148.1, 224/148.2, 209, 901, 148.4, 148.6; 222/175, 529, 213

(56) References Cited

U.S. PATENT DOCUMENTS

| | | | | |
|---|---|---|---|---|
| 1,650,764 A | | 11/1927 | Marin | |
| 4,176,772 A | | 12/1979 | Danon | |
| 4,265,381 A | | 5/1981 | Muscatell | |
| 4,702,473 A | | 10/1987 | Paquette | |
| 4,768,688 A | | 9/1988 | Harrigan | |
| 4,775,564 A | | 10/1988 | Shriver et al. | |
| 4,790,361 A | | 12/1988 | Jones et al. | |
| 4,988,097 A | | 1/1991 | Smith et al. | |
| 5,060,833 A | | 10/1991 | Edison et al. | |
| 5,199,590 A | * | 4/1993 | Grandahl et al. | 220/666 |
| 5,207,362 A | | 5/1993 | Janus et al. | |
| 5,207,719 A | | 5/1993 | Janus | |
| 5,261,570 A | | 11/1993 | Hippely et al. | |
| 5,431,308 A | | 7/1995 | Tchen | |
| 5,476,194 A | | 12/1995 | Hippely et al. | |
| 5,573,129 A | | 11/1996 | Nagata et al. | |
| 5,584,413 A | | 12/1996 | Jung | |
| 5,622,293 A | | 4/1997 | LeFevre | |
| 5,632,397 A | | 5/1997 | Fandeux et al. | |
| 5,669,529 A | | 9/1997 | Levit | |
| 5,746,339 A | | 5/1998 | Petre et al. | |

FOREIGN PATENT DOCUMENTS

| | | |
|---|---|---|
| FR | 2754724 | 4/1998 |

* cited by examiner

*Primary Examiner*—Joseph M. Moy
(74) *Attorney, Agent, or Firm*—Rodman & Rodman

(57) ABSTRACT

A container (20) for a flowable material for carrying on a person. The container includes an elongate vessel (22) for containing the flowable material, the vessel including a first end (24), a second end (26) and a longitudinal axis. The vessel is bendable so that the first end and the second end can be brought toward each other. Further, the vessel is deformable axially to alter the length and volume of the vessel. A sealable inlet (28) is provided for introducing the flowable material into the vessel (22), while a sealable outlet is provided for expelling the flowable material from the vessel.

12 Claims, 2 Drawing Sheets

WEARABLE CONTAINER

FIELD OF INVENTION

The present invention relates to a container for a flowable material which container can be carried on a person.

BACKGROUND OF INVENTION

Typically, foods and beverages are sold or dispensed in containers which must be held with one or both hands. For example, beverages such as soft drinks and slushes are often dispensed from machines into paper or plastic cups. These cups sometimes have lids to limit the potential for spilling but must be held in order to be transported, thus occupying one or both hands. This requirement is both a nuisance and a hazard, since hands and fingers that are occupied with a food or beverage container are not available to steer a bicycle or drive a car effectively.

Some attempts have been made in the prior art to develop containers for foods, beverages and other flowable materials which can be carried on a person without occupying the hands and fingers.

U.S. Pat. No. 4,702,473 (Paquette) describes a combination hand weight and water dispenser which is adapted to be carried in a hand. The dispenser includes a D-shaped body with a discharging aperture. Although the design of the dispenser may permit some limited use of the fingers when it is being held, the dispenser is still intended to be carried in a hand.

U.S. Pat. No. 4,768,688 (Harrigan) describes a suntan lotion bracelet formed from a tubular body configured in the shape of a ring. The bracelet may either form a continuous ring or it may have ends which are brought together to form a ring. Orifices for filling and dispensing the suntan lotion are either located at the ends of the bracelet or at a point or points along the bracelet. Suntan lotion is dispensed from the bracelet by squeezing the tubular body. Although the bracelet is bendable, it is not axially deformable to alter its volume or its length.

U.S. Pat. No. 5,060,833 (Edison et al) describes a water system which allows cyclists to drink liquids while riding. The system includes a collapsible liquid container which is stored in a flexible backpack worn by the cyclist. A mouthpiece worn by the cyclist is connected to the container with a length of tubing. The mouthpiece is a valve device which permits liquid to flow from the container to the cyclist's mouth when the mouthpiece is compressed between the teeth. This system is relatively complicated and may not be practical for everyday use.

U.S. Pat. No. 5,207,362 (Janus et al) and U.S. Pat. No. 5,207,719 (Janus) both describe a liquid container pouch which is worn on the chest and is held in place with straps which extend around the neck. An adhesive is placed along the back side of the liquid container so that the container can be secured to the clothing of a user in order to reduce movement of the container during physical activity. A straw can be extended upwards from the liquid container to facilitate drinking from the container while it is being worn.

U.S. Pat. No. 5,261,570 (Hippely et al) and U.S. Pat. No. 5,476,194 (Hippely et al) both describe a liquid dispenser which is relatively flat, fits in the palm of a person's hand, and may be carried in a pocket or hung around the neck with a cord or tube attached to the dispenser. The dispenser has at least one flexible wall portion which allows the dispenser body to be compressed to discharge liquid from the dispenser through a dispensing aperture.

U.S. Pat. No. 5,431,308 (Tchen) describes an apparatus which can be worn on the head of an athlete and which can be used to store and dispense fluids. The apparatus includes an elongated flexible hollow tube having closed ends, straps with fasteners extending from the ends, a flexible straw which communicates with the interior of the hollow tube and an aperture with a filler plug removably received thereover to allow filling of the hollow tube with liquids. The hollow tube is extended around the head of a user and is held in place with the straps so that the apparatus is effectively worn as a "headband". Although the hollow tube is flexible and is thus presumably bendable, it is not axially deformable to alter its length or volume.

U.S. Pat. No. 5,622,293 (LeFevre) describes a wearable liquid container which is similar in structure to the bracelet described in the Harrigan patent. The container is formed from a flexible tubular member having a pair of ends which are connectable to form a loop. One of the ends has an opening to permit access to the liquid carried in the container. Several structures for connecting the ends of the container are disclosed. The container may be worn either by being looped around a body part or by being wrapped around a body part. The container is not axially deformable to alter its length or volume.

U.S. Pat. No. 5,669,529 (Levit) describes a water dispenser for runners which also serves as a wrist weight. The dispenser includes an arcuately formed reservoir having pleated collapsible sides, a water dispensing control valve with a cap, and a sheathing to enclose the reservoir. The reservoir is inserted in the sheathing and is held in place around the wrist of a runner by fasteners located on the sheathing. Although the pleats facilitate alteration of the volume of the dispenser, the pleats are parallel with the axis of the dispenser so that alteration of the volume of the dispenser does not axially deform the dispenser or alter its length.

It is also well known in the prior art to provide a container which is axially collapsible for storage purposes and axially extendible to increase its volume for use as a container. Examples include U.S. Pat. No. 4,775,564 (Shriver et al), U.S. Pat. No. 5,573,129 (Nagata et al), U.S. Pat. No. 5,584,413 (Jung), U.S. Pat. No. 5,632,397 (Fandeux et al) and U.S. Pat. No 5,746,339 (Petre et al).

None of the prior art described above, however, describes a container for a flowable material which can be carried on a person and which is both bendable and axially deformable to alter the length and volume of the container. There is a need for such a container which can be carried on a person and from which the flowable material can be dispensed by axial deformation of the container. There is also a need for such a container which permits alteration of its length by axial deformation of the container.

SUMMARY OF INVENTION

The present invention relates to a container for a flowable material, which container can be carried on a person. The container may be used to contain any flowable material including powders, grains, gels, foams, creams and liquids. The container is especially suited for use to contain foods and beverages.

There are two main features of the invention. First, the container is elongated and bendable so that it can be adapted to be carried on a person. For example, the container may be carried around a person's neck, waist, leg, arm or head by bringing the ends of the container together around the desired body part or by wrapping the container around the desired body part. The container may also be carried on a belt loop, on the handlebars of a bicycle or on any other suitable object so that the hands and fingers of the user are available to perform other tasks.

Second, the container is axially deformable to alter its length and volume, which facilitates expelling of the flowable material from the container without the use of a utensil such as a drinking straw. In a preferred embodiment of the invention, the axial deformability of the container also facilitates adjustment of the length of the container so that it can be carried by persons of different sizes and so that it can be carried on different body parts.

In one aspect of the invention, the container comprises an elongated vessel for containing the flowable material, the vessel including a first end, a second end and a longitudinal axis, a sealable inlet for introducing the flowable material into the vessel and a sealable outlet for expelling the flowable material from the vessel, wherein the vessel is bendable so that the first end and the second end can be brought toward each other and wherein the vessel is deformable axially to alter the length and volume of the vessel.

The container preferably includes a fastener for holding the first end and the second end relative to each other to assist in enabling the container to be carried on a person. Any fastener or method of fastening may be used.

The sealable inlet and the sealable outlet may be comprised of separate or distinct openings in the vessel, located at any desired positions in the vessel. Preferably, however, the vessel defines a single sealable opening which comprises both the inlet and the outlet.

The sealable opening may be located at any desired position in the vessel, but in the preferred embodiment the sealable opening is located at the first end of the vessel. Finally, the sealable opening may be sealable using any method, mechanism or device for sealing an opening. In the preferred embodiment, the sealable opening is sealed with a screw cap.

The container further preferably comprises a sheath for containing the vessel. The sheath may be comprised of any material which is suitable for both containing the vessel and for carrying on the person. In the preferred embodiment, the sheath is comprised of an insulating material to insulate the user of the container either partially or fully from hot or cold material contained in the vessel. Furthermore, in the preferred embodiment, the sheath is constructed of a material that permits the application of printing such as advertising thereon.

The vessel may be contained in the sheath in any manner, For example, the sheath may be integrally formed with the vessel or otherwise associated with the vessel such that the sheath is not removable therefrom. Preferably, however, the vessel is contained in the sheath such that the vessel is removable from the sheath.

The fastener may be associated with any element of the container, including the vessel, the inlet, the outlet or the sheath, and in any manner which enables the fastener to hold the first and second ends relative to each other.

Preferably, however, the fastener is associated with the sheath so that the first end and the second end can be held relative to each other when the vessel is contained in the sheath. Where the fastener is associated with the sheath, any fastener or method for fastening may be used which is compatible with the sheath and which can hold the first and second ends relative to each other when the vessel is contained in the sheath. In the preferred embodiment, the fastener comprises a hook and loop type fastener.

The container may be constructed in any manner which facilitates bending of the vessel to bring the first and second ends toward each other. For example, the vessel may be constructed of a number of rigid or semi-rigid segments which can be articulated relative to each other to bend the vessel. Preferably, however, the vessel is constructed of a flexible material to facilitate bending of the vessel.

Finally, the axial deformability of the vessel may be achieved in any manner which also alters the length and volume of the vessel. Preferably, the vessel includes a circumferential wall extending from the first end to the second end. The circumferential wall may be constructed of any material, and may be comprised of any structure, mechanism or device which permits the axial deformation of the vessel while altering the length and volume of the vessel.

In the preferred embodiment, the circumferential wall comprises a plurality of pleats substantially transverse to the longitudinal axis of the vessel and spaced axially along at least a portion of the vessel so that the circumferential wall can be folded at the pleats to alter the length and volume of the vessel.

The pleats may be designed to retain their position when folded or extended, or they may be designed to tend to return to their original position when a force used to fold or extend them is removed. In the latter case, the length of the vessel can be controlled by sealing the sealable opening so that the vessel will seek a length where the pressure inside the vessel is balanced with the ambient pressure outside the vessel.

BRIEF DESCRIPTION OF DRAWINGS

Embodiments of the invention will now be described with reference to the accompanying drawings, in which.

DETAILED DESCRIPTION

Figure 1:
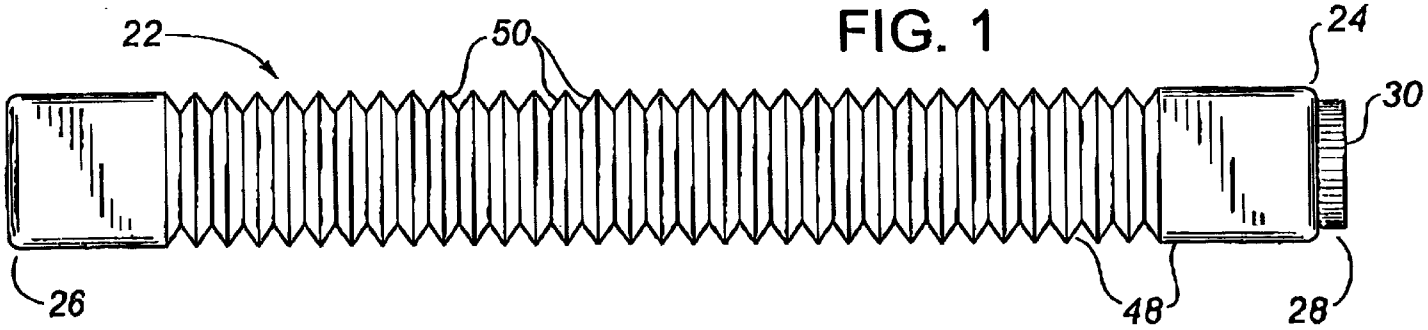
FIG. 1 is a side view of a vessel constructed in accordance with the invention.
Figure 3:
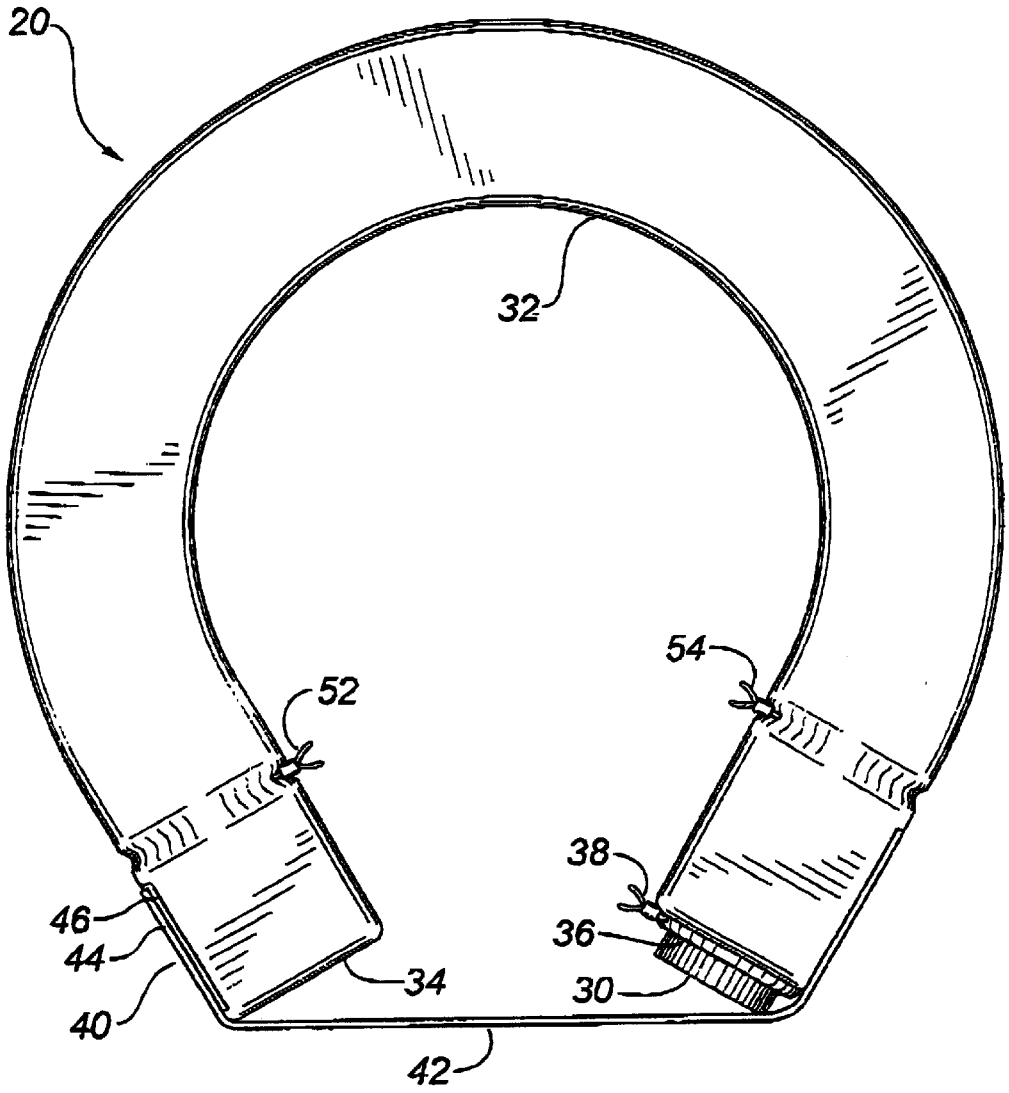
FIG. 3 is a pictorial view of an assembled contain constructed in accordance with the invention, including a vessel, a sheath and a fastener.

Referring to FIG. 3, there is depicted an assembled container (20) for flowable material according to the preferred embodiment of the invention. Referring to FIG. 1, the container (20) includes a vessel (22) for containing the flowable material. The vessel (22) has a first end (24) and a second end (26).

The vessel (22) may be used to contain any flowable material. In this patent application, a "flowable material" includes fluids, any solids which are in the form of discrete particles such as grains or powders which can move relative to each other, and combinations of fluids and solids such as solutions, mixtures and suspensions.

In the preferred embodiment, however, the vessel is intended for use to contain a beverage such as a fountain drink or a slush drink. Specifically, in the preferred embodiment, the invention is intended primarily for use by restaurants, fast food outlets and convenience stores to replace paper and plastic cups as a container for such beverages, due to the marketing opportunities that such use provides, as will be discussed below.

The vessel (22) is elongated and hollow and is formed to have a relatively straight longitudinal axis. The vessel (22) and its longitudinal axis are, however, bendable into a variety of shapes to facilitate carrying of the container on a person or on another object such as a belt loop or bicycle handlebars, Although the vessel (22) may be constructed of a variety of cross-sections and yet still be bendable, in the preferred embodiment the vessel (22) is of circular cross-section.

The vessel (22) may be constructed of a number of rigid or semi-rigid segments which can be articulated relative to each other to bend the vessel (22). In the preferred embodiment, the vessel (22) is constructed of a flexible material such as a flexible plastic. The bendability of the vessel (22) makes it possible for the container (20) to be carried on a person or other object, either by forming a loop with the container (20) around the body part or object or by wrapping the container (20) around the body part or object.

In the preferred embodiment, the vessel (22) is approximately 45 centimeters long when filled to capacity so that it is long enough to be worn comfortably in a loop around a person's neck. It is also approximately 5 centimeters in outside diameter and capable of holding approximately 500 milliliters of beverage. These dimensions may be increased or decreased as may be required to satisfy any particular design objectives. For example, the vessel (22) may be made available in a variety of lengths and diameters to correspond with different sizes of beverage which might be offered for sale by a vendor.

In the preferred embodiment, the vessel (22) includes a sealable opening (28) which is located at the first end (24) of the vessel (22). The sealable opening (28) is threaded and is sealed with a screw cap (30) which prevents leakage of the flowable material from the vessel (22). The sealable opening (28) serves both as an inlet for introducing flowable material into the vessel (22) and as an outlet for expelling flowable material from the vessel (22).

The functions of inlet and outlet may, however, be separated into two or more separate openings which may be located anywhere on the vessel (22). In addition, other forms of sealable opening (28) may be utilized. For example, the sealable opening may include a valve or other device to selectively prevent passage of the flowable material through the sealable opening (28).

Figure 2:
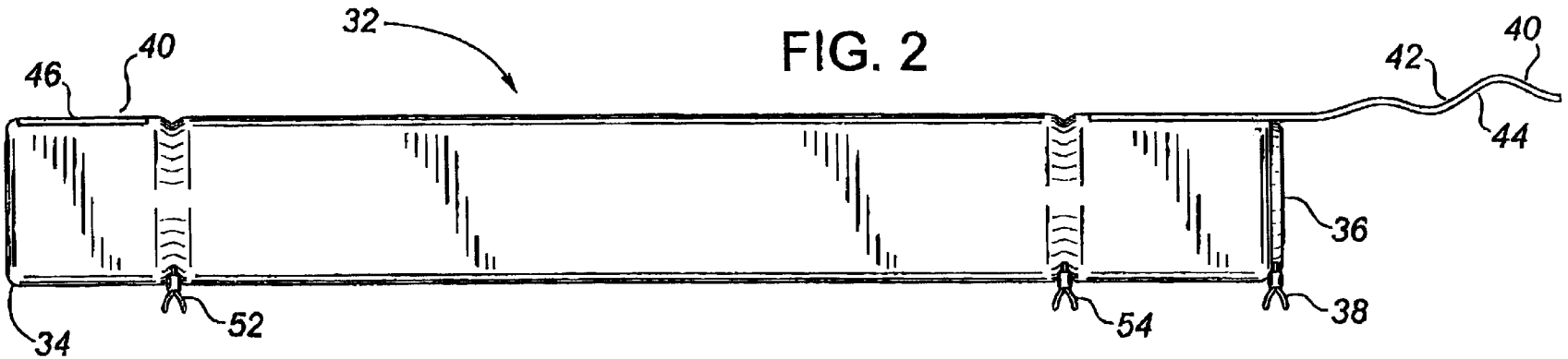
FIG. 2 is a side view of a sheath constructed in accordance with the invention, including a fastener.

Referring to FIG. 2, in the preferred embodiment the container (20) includes a sheath (32) for containing the vessel (22). The sheath (32), although optional, is capable of several functions. First, the sheath (32) may potentially be provided in a wider range of colors and patterns than the vessel (22) so that the sheath (32) may serve to make the container more visually attractive. Second, the sheath (32) may be constructed of a suitable material or materials which will provide either partial or full insulation to the wearer from very hot or very cold beverages which are contained in the vessel. Third, the sheath (32) may be customized without changing the construction of the vessel (22) to include advertising material specific to the vendor of the container (20).

The sheath (32) may take any form which performs one or more of the above functions. In the preferred embodiment, the sheath (32) comprises a Gore-Tex (™) sleeve which has a closed end (34) and an open end (36) to enable the vessel (22) to be inserted into the sheath (32). The sheath (32) is of slightly greater length and diameter than the vessel (22) so that the vessel (22) can be contained fully in the sheath (32).

In the preferred embodiment, the sheath (32) further comprises a drawstring (38) adjacent to the open end (36) for securing the vessel (22) in the sheath (32). Alternatively, the drawstring (34) may be omitted or the open end (36) of the sheath (32) may be elasticized for securing the vessel (22) in the sheath (32).

Referring to FIG. 3, in the preferred embodiment the container (20) includes a fastener (40) which is used to hold the ends (24,26) of the vessel relative to each other to assist in enabling the container (20) to be carried on a person. Any form of fastener (40) which is capable of holding the ends (24,26) of the vessel (22) relative to each other may be used, including straps, snaps, buttons, magnets, hook and loop type fasteners such as Velcro (™) and combinations of such devices. The fastener (40) may be associated directly with the vessel (22) if no sheath (32) is provided as part of the container (20). Alternatively, as in the preferred embodiment, the fastener (40) may be associated with the sheath (32).

In the preferred embodiment, the fastener (40) comprises a strap (42) which extends from the open end (36) of the sheath (32). The strap (42) includes a first side (44) of a hook and loop type fastener. A second side (46) of the hook and loop type fastener is located on the sheath (32) adjacent to the closed end (34) of the sheath (32) so that when the vessel (22) is contained within the sheath (32) the ends (24,26) of the vessel (22) may be held relative to each other by affixing the strap (42) to the second side of the hook and loop type fastener at the dosed end (34) of the sheath (32).

The vessel (22) is deformable axially to alter the length and volume of the vessel (22). This feature serves at least two functions. First, the flowable material may be expelled from the vessel (22) without the use of utensils such as drinking straws or spoons by compressing the vessel (22) a ally to reduce its length and volume and thus force the flowable material from an unsealed sealable opening (28). Second, the length of the vessel (22) may be altered to facilitate filling of the vessel (22) to different capacities, to reduce the size of the vessel (22) for storage, or to permit the vessel (22) to be adaptable to be carried on different body parts or by persons of different sizes.

Various structures for the vessel (22) may be utilized so that the vessel (22) is deformable axially to alter its length and volume. For example, the vessel (22) could comprise a number of telescoping segments. In the preferred embodiment, however, the vessel (22) includes a circumferential wall (48) extending from the first end (24) to the second end (26) of the vessel (22). The circumferential wall (48) comprises a plurality of pleats (50) which are substantially transverse to the longitudinal axis of the vessel (22) and which are spaced axially along at least a portion of the length of the vessel (22) so that the circumferential wall (48) can be folded at the pleats (50) to alter the length and volume of the vessel (22).

The length of the vessel (22) can be altered by folding or unfolding the circumferential wall (48) at the pleats (50) through the application respectively of a compressive or tensile axial force to the vessel (22). The circumferential wall (48) and the pleats (50) may be designed either so that the vessel (22) returns to a "natural length" upon removal of the axial force or so that the vessel (22) maintains its length upon removal of the axial force.

In the former case, the circumferential wall (48) may be relatively thick and the pleats (50) may be relatively rigid, with the result that the vessel (22) is potentially of more sturdy construction. A desired length of the vessel (22) may be maintained to some extent by compressing or extending the vessel (22) to the desired length with the screw cap (30) removed and then replacing the screw cap (30) while holding the vessel (22) at the desired length so that the length of the vessel (22) is maintained by the natural balancing of the pressure inside the vessel (22) with the ambient pressure outside the vessel (22).

In the latter case, the circumferential wall (48) may out of necessity be relatively thin and the pleats (50) may be relatively pliable and may be designed so that once a fold is created in the circumferential wall (48) the fold will remain there until a sufficient tensile force is applied to remove the fold. Although the embodiment of this latter case is somewhat less sturdy an that of the former case, it offers the advantage of providing easier length adjustment of the vessel (22), which in turn may result in easier expelling of the flowable material from tie vessel (22).

Finally, in the preferred embodiment the vessel (22) and the sheath (32) are held longitudinally relative to each other when the vessel (22) is contained in the sheath (32) so that the sheath (32) will move with the vessel (22) as the length of the vessel (22) changes. In the preferred embodiment, this result is achieved with the use of a second drawstring (52) located on the sheath (32) adjacent to the closed end (34) of the sheath (32) and the use of a third drawstring (54) located on the sheath (32) adjacent to the open end (36) of the sheath (32). These drawstrings (52,54) may be cinched up when the vessel (22) is contained in the sheath (32) to assist the ends (24,26) of the vessel (22) in maintaining their position relative to the ends (34,36) of the sheath (32).

Use of the second drawstring (52) and the third drawstring (54) is optional. Furthermore, other devices and methods may be utilized to hold the vessel (22) and the sheath (32) longitudinally relative to each other, including hooks, snaps, elastics and ties associated with the vessel (22) and the sheath (32). The same result may also be achieved if the sheath (32) is formed so that it fits snugly over the vessel (22), particularly if the sheath (32) is constructed of a material that can stretch elastically.

The operation of the container (20) is as follows. First, the container (20) may either be distributed as a complete unit or the vessel (20) and the sheath (32) may be distributed separately. This enables the sheath. (32) to be customized while allowing the vessel (22) to be somewhat more generic.

Second, the vessel (22) may be contained in the sheath (32) or removed from the sheath (32) when the vessel (22) is filled with a flowable material such as a beverage. To fill the vessel (22), the screw cap (30) is first removed and the beverage is then dispensed into the vessel (22). The screw cap (30) is then replaced.

Third, if the vessel (22) is not already contained in the sheath (32), the vessel (22) is inserted into the sheath (32) and the drawstring (38) is pulled to secure the vessel in the sheath (32).

Fourth, the container (20) is adapted to be carried on a person or on some other object by bending the container (20) around a body part or the object and then securing the fastener (40) so that the ends (24,26) of the vessel (22) are held relative to each other. Alternatively, the container (20) is wrapped around a body part or the object and then the fastener (40) is secured to maintain the container (20) in place. The fastener (40) is secured by connecting the ends (44,46) of the fastener together.

To drink from the container (20), the fastener (40) is unfastened, the container (20) is removed from the body part or other object and the screw cap (30) is removed from the vessel (22). It is not necessary to remove the vessel (22) from the sheath (32). A compressive axial force is then applied to the vessel (22) to force the flowable material from the vessel through the sealable opening (28). Alternatively, a straw or spoon may be inserted in the sealable opening (28) or a combination of techniques may be used. After sufficient flowable material has been expelled from the vessel (22), the screw cap (30) may be replaced and the container (20) may once again be prepared for carrying on a person or on some other object.

The invention thus provides a simple yet effective way of carrying flowable materials without the use of hands or fingers.

The embodiments of the invention in which an exclusive property or privilege is claimed are defined as follows:

1. A container for a flowable material for carrying on a person, the container comprising:

(a) an elongated vessel for containing the flowable material, the vessel including a first end, a second end and a longitudinal axis, wherein the vessel is bendable so that the first end and the second end can be brought toward each other and wherein the vessel is deformable axially to alter the length and volume of the vessel;

(b) a sealable inlet for introducing the flowable material into the vessel; and (c) a sealable outlet for expelling the flowable material from the vessel.

2. The container as claimed in claim 1, further comprising a fastener for holding the first end and the second end relative to each other.

3. The container as claimed in claim 2 wherein the vessel defines a single sealable opening which comprises both the inlet and the outlet.

4. The container as claimed in claim 3 wherein the sealable opening is located at the first end of the vessel.

5. The container as claimed in claim 4 wherein the sealable opening is sealed with a screw cap.

6. The container as claimed in claim 2, further comprising a sheath for containing the vessel.

7. The container as claimed in claim 6 wherein the vessel is removable from the sheath.

8. The container as claimed in claim 7 wherein the fastener is associated with the sheath so that the first end and the second end can be held relative to each other when the vessel is contained in the sheath.

9. The container as claimed in claim 8 wherein the fastener comprises a hook and loop type fastener.

10. The container as claimed in claim 9 wherein the sheath is comprised of an insulating material.

11. The container as claimed in claim 2 wherein the vessel is constructed of a flexible material to facilitate bending of the vessel.

12. The container as claimed in claim 11 wherein the vessel includes a circumferential wall extending from the first end to the second end and wherein the circumferential wall comprises a plurality of pleats substantially transverse to the longitudinal axis of the vessel and spaced axially along at least a portion of the vessel so that the circumferential wall can be folded at the pleats to alter the length and volume of the vessel.

* * * * *